United States Patent [19]

Benzaquén

[11] 4,167,600

[45] Sep. 11, 1979

[54] SUPERFICIALLY DYED FABRICS

[75] Inventor: José Benzaquén, Caseros, Argentina

[73] Assignee: Benzaquen, Sociedad Anonima, Industrial et al., Argentina

[21] Appl. No.: 547,179

[22] Filed: Feb. 5, 1975

Related U.S. Application Data

[62] Division of Ser. No. 311,261, Dec. 1, 1972, Pat. No. 3,872,557.

[51] Int. Cl.[2] ..... B32B 33/00

[52] U.S. Cl. ..... 428/91; 8/17; 8/62; 428/95; 428/96

[58] Field of Search ..... 428/88, 85, 91, 95, 428/96; 8/17, 62; 28/72 P, 74 P

[56] References Cited

U.S. PATENT DOCUMENTS

| | | | |
|---|---|---|---|
| 3,037,262 | 6/1962 | Spencer | 428/91 |
| 3,191,258 | 6/1965 | Spencer | 428/91 |
| 3,282,721 | 11/1966 | Iseki | 428/91 |
| 3,931,427 | 1/1976 | Benzaquen | 428/91 |

*Primary Examiner*—Marion E. McCamish

*Attorney, Agent, or Firm*—Allegretti, Newitt, Witcoff & McAndrews

[57] ABSTRACT

Pleasing tonality is obtained in a fabric by subjecting a moving, superficially dyed fabric to abrasion. The fabric, while being processed, has a low longitudinal tension and the peripheral velocity of the abrasion means is different than the moving fabric.

8 Claims, 9 Drawing Figures

SUPERFICIALLY DYED FABRICS

This is a division of application Ser. No. 311,261, filed Dec. 1, 1972, now U.S. Letters Pat. No. 3,872,557.

BACKGROUND OF THE INVENTION

The present invention relates to a method and apparatus for conditioning fabrics and the specific fabric that is produced by the method. More particularly, the present invention relates to a process which produces on already-dyed fabrics, novel physical effects such as appearance and feel, as well as coloring and/or tone and fabrics produced thereby.

The clothing industry produces articles which have the publicized peculiarity of random "discolor", that is, as a result of wear or special washings they present a premature aging appearance.

These "discolored" articles of clothing are generally made with fabrics wherein the yarn is dyed substantially superficially, that is, they easily lose their coloring so that, due to washing and/or wearing out, they present the mentioned appearance of discoloration.

The present invention, on the other hand, while it does cause the fabric to have a predetermined change in tone or color, does not involve an accidental, capricious or unforeseeable tone change and, at the same time, combines the tone effect with a plush or velvet-like finish. The fabric thus produced, in relation to the original characteristics of the base fabric, presents a notable improvement in regard to its visual appearance, as well as its "feel" or "touch", since it has characteristics similar to suede.

The fabrics utilized in the present invention can be of various types in relation to the raw material, weaving and thickness used, since the process is readily adjustable in accordance with the type and characteristics of the base fabric. However, the best conditions and results are obtained when dealing with fabrics dyed superficially, particularly cotton fabrics and cotton blends.

There are also known fabrics called "indigo" type because this constitutes their coloration base. This coloration is preferably realized on the warp threads. However, the woof threads may also be dyed in a superficial form.

Dyeings have also been obtained of the so-called "padozoic" type, as well as dyeings, whether of the warp threads, woof threads, or both together, with naphtholated bases.

SUMMARY OF THE INVENTION

An innovation for obtaining superficial dyeing of the yarn in fabrics has been based on the prior priming or "gluing" of the yarn and later dyeing the yarn with, for example, naphtholated bases. The prior priming forms a laminate shield around the thread which causes the color fixing on the thread to be superficial, without affecting the nucleus of the thread.

The prior primed fabrics, whatever may be the exact form used for dyeing the fabric or the materials employed, are submitted to the process in question to obtain a textile fabric which presents a predetermined change of tone and/or color with a simultaneous plush or velvet-like finish.

There are known fabrics, especially cotton, in which, by a process of shagging, a greater bulk is given to the fabric. This known shagging process is based on submitting the base fabric to the action of welts, formed by steel barbs, which penetrate into the fabric and separate the fibers of the fabric, thereby producing a more spongy or porous fabric mass, with greater bulk. Preferably, the separated fibers are of substantial length. However, this type of treatment affects the deep structure of the yarn. In addition, in order to obtain the desired effect, it is necessary to work on yarns of low torsion.

The process of the invention, on the other hand, is based on the realization of a superficial abrasion in a repeated or serial form by regulating the support tension of an abrasion means, the relative speed between the advance of the fabric and the abrasion means whose point size is also variable, as well as the superficial arc of contact, between the abrasion means and the fabric. The lengthwise tension of the fabric is very important for the process in that the superficial abrasion is realized in a movement composed of the abrasion means and the advancing fabric, which notably improves the finished aspect of the fabric, since it eliminates the possibility of leaving streaks or "scratches" in the plush while, at the same time, maintaining the deep structure of the yarn.

The process of the present invention is further improved by the injection of steam into the fabric. This makes it possible to accentuate the mentioned advantages of appearance and feel of the fabric obtained.

It is already known that in a dry environment, textile fibers become charged with static electricity which causes the raised fibrils of the fabric to repel one another, that is, they tend to separate. In a humid environment, on the other hand, due to the absence or lessening of the static charge, the hair or fibrils tend to become flattened. This results in different superficial abrasion on the fabric and produces special effects. In addition, the humidity produces swelling of the fibers, which notably improves the suede-like effect obtained by the abrasion.

Thus, the process of the present invention is practiced over at least one of the faces of the fabric, in which there is effected a superficial abrasion by a movement made up of the advancing fabric, combined with a dampening with steam which notably improves its conditions.

It should also be noted that this process can be practiced on "printed" fabrics, that is, base fabrics with the above described characteristics on which there has been formed a "relief" and which are later submitted to a superficial abrasion in the previously mentioned manner. The resulting fabric has, in addition to the change in tone which is accentuated, a suede-like quality and an aspect of being "tooled". This process treats fabrics with yarns dyed in a substantially superficial form by accentuating its bi-tonality when the dyeing has been carried out only on the yarn in one direction, that is, either those of the warp or those of the woof.

A notable improvement is obtained in the chracteristics of substantially coarse fabrics, such as canvas and denim and, in particular when the yarns of the base fabrics utilized have special, substantially high torsions which preferably tend, in the threads of the warp, and in those of the woof, to be approximately equal. Such torsions are calculated to avoid the ravelling of the threads, which keep their deep structure intact.

To achieve these operations, a machine has been designed which is basically symmetrical in form in relation to a transverse median plane of its operating means.

The means of abrasion are rotary mounted and are connected to the respective connecting rod-crankshaft mechanisms. This means that the abrasion means, in conjunction with their rotary movement, are displaced transversely to the direction of advance in a compound movement, said transverse displacement being determined by the speed of rotation.

In addition, the machine includes a novel device for regulating the fabric feeding rollers, thus achieving a highly efficient control of the lengthwise tension of advance of the fabric during the treatment. These roller regulating devices operate so that one of them constitutes the "coiler" of the treated fabric, that is the motor means of advance of the fabric and the similar one at the other end, loaded with the fabric to be treated, constitutes a means of pneumatic braking by regulatable friction. This friction regulation determines the greater or lesser lengthwise tension of the fabric during the treatment.

The remaining advantages and characteristics of the invention can be appreciated by reference to the various figures in which a preferred embodiment of the machine mentioned is illustrated and represented.

BRIEF DESCRIPTION OF THE DRAWINGS

FIG. 3 is a view of a lengthwise section of the regulating device for the winding and feeding means of the fabric.

Figure 7A:
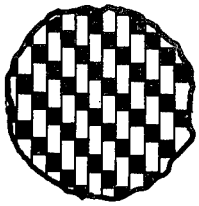
FIG. 7 is a view of the obverse side of the fabric treated according to the present invention with a corner folded over to show the reverse side. This fabric corresponds to a base on which, prior to the treatment, relief designs have been imprinted.
Figure 7:
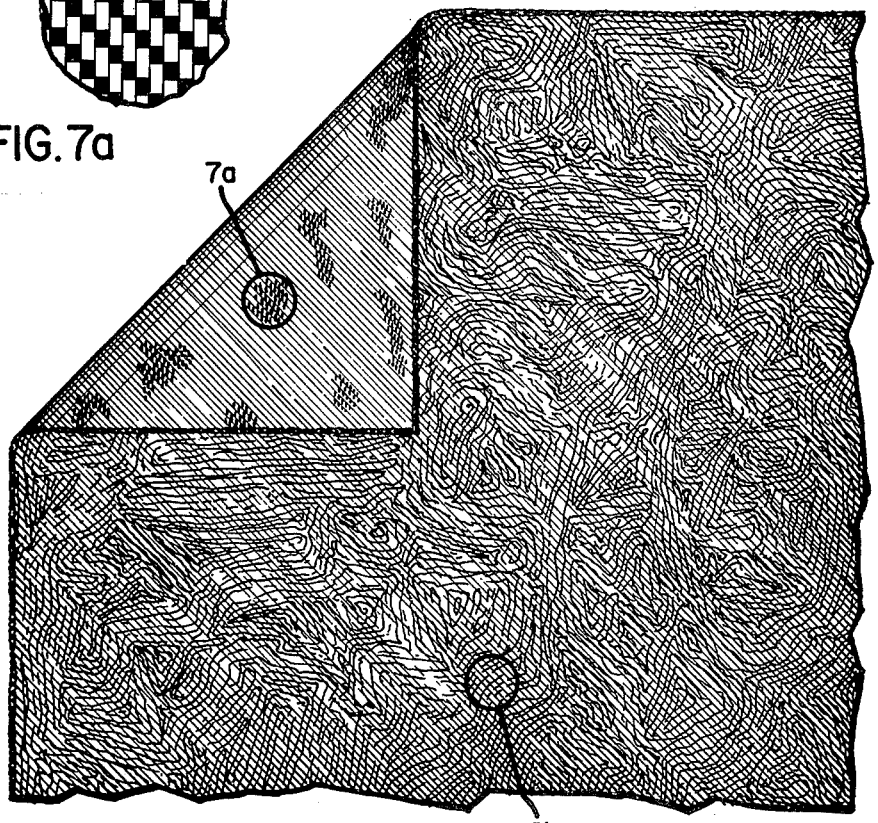
Figure 7B:
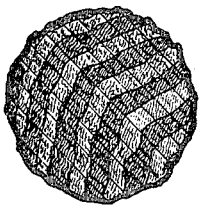

FIGS. *7a* and *7b* are enlarged portions of opposite sides of the fabric as shown in circles *7a* and *7b*, respectively, in FIG. 7.

DETAILED DESCRIPTION OF THE DRAWINGS

In the various figures, the equal or equivalent parts have been indicated with similar reference characters.

Figure 1:
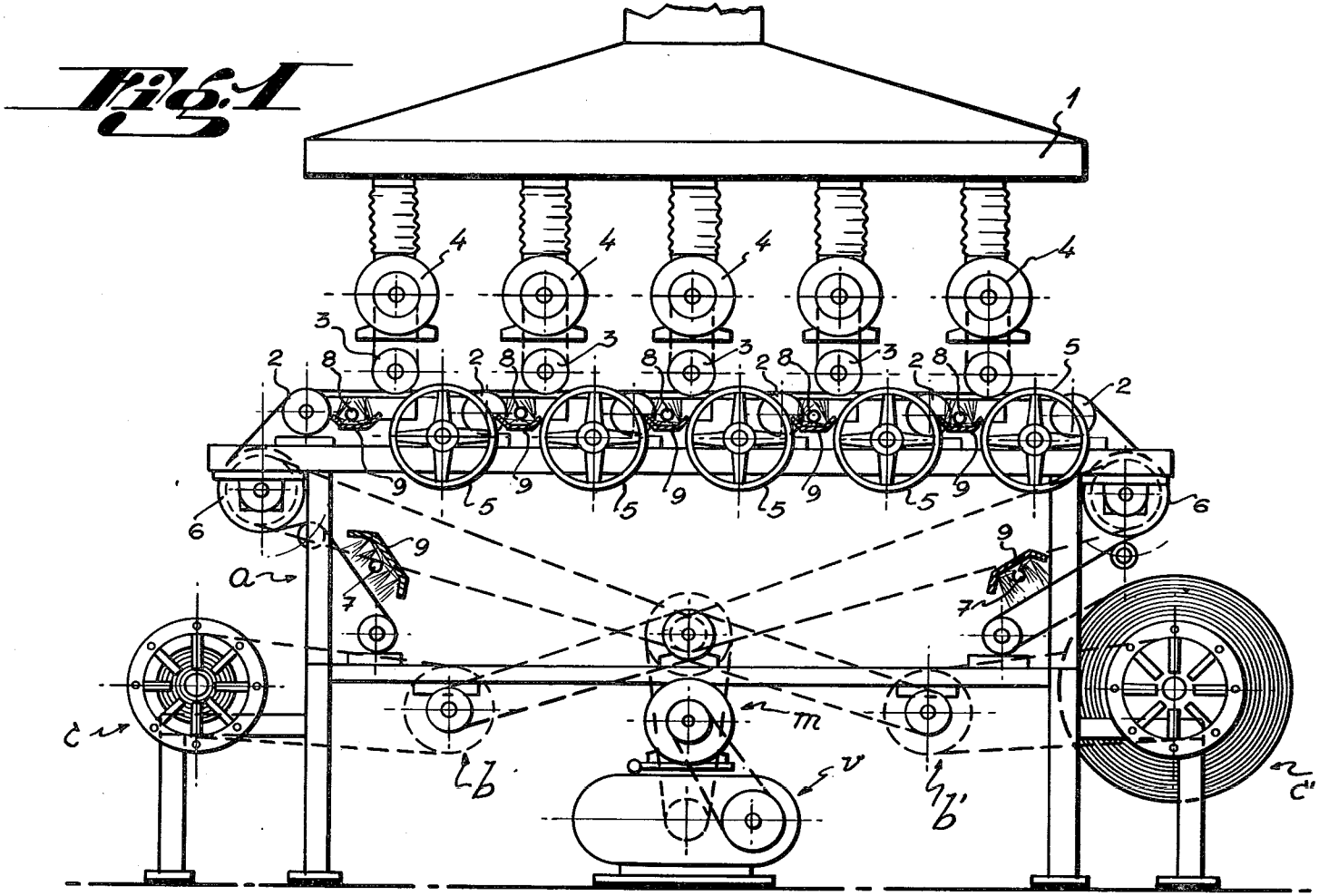
FIG. 1 is an elevational view in which the entire apparatus which can be used in the process of the present invention is shown in schematic form.

As can be seen in FIG. 1, a machine to be utilized in the present invention has a support frame *a* and, in its upper part, a bell portion 1 of an aspiration mechanism.

In the illustration the machine, is represented schematically in side elevation and, is substantially symmetrical with respect to a transverse median plane.

On the upper part of the frame *a* are guide rollers 2 transversely positioned along the course of the fabric. Between the guide rollers are positioned grinding cylinders 3 which comprise the preferred means for abrasion of the fabric. The size of the grains on the surface of cylinders 3 can be varied.

Grinding cylinders 3 are powered by the respective motors 4 mounted over the cylinders. Wheels 5 may be provided to regulate pressure and speed of the cylinders by way of suitable control linkages (not shown). Also regulated is the lengthwise tension of the fabric as it passes through the apparatus. The relative height of the grinding cylinders 3 with respect to the guide rollers 2 between which they are located may also be regulated by mechanisms (not shown), but within the selection of one skilled in the art. Thus, the holding arc of the fabric over the surface of the grinding cylinders 3, as well as the pressure of the grinding cylinders on the fabric, may be regulated as the fabric advances.

At both ends of the machine, on a plane below the position of the guide rollers, are mounted rollers 6 which are connected by a suitable transmission to an assembly which carries the main motor m and speed regulator v. Also connected to the assembly by braces are respective winders c and c′ positioned at each end of the entire assembly.

The machine also includes a steam installation including pipes 7 placed transversely at both ends of the fabric path as it passes through the apparatus. Additional steam pipes 8 are also placed transversely along the fabric path between the guide rollers 2.

So that there will be no direct flow of steam onto the fabric and for a better distribution of the steam on the fabric, pipes 7 and 8 are combined with deflecting screens 9. In this combination, the outlet spouts of the pipes are distributed along the length of pipes 7 and 8 with the spouts directed toward screens 9.

Pipes 7 and 8 each have independent control means which permit perfect regulation of the dampening of the fabric in the process.

Figure 2:
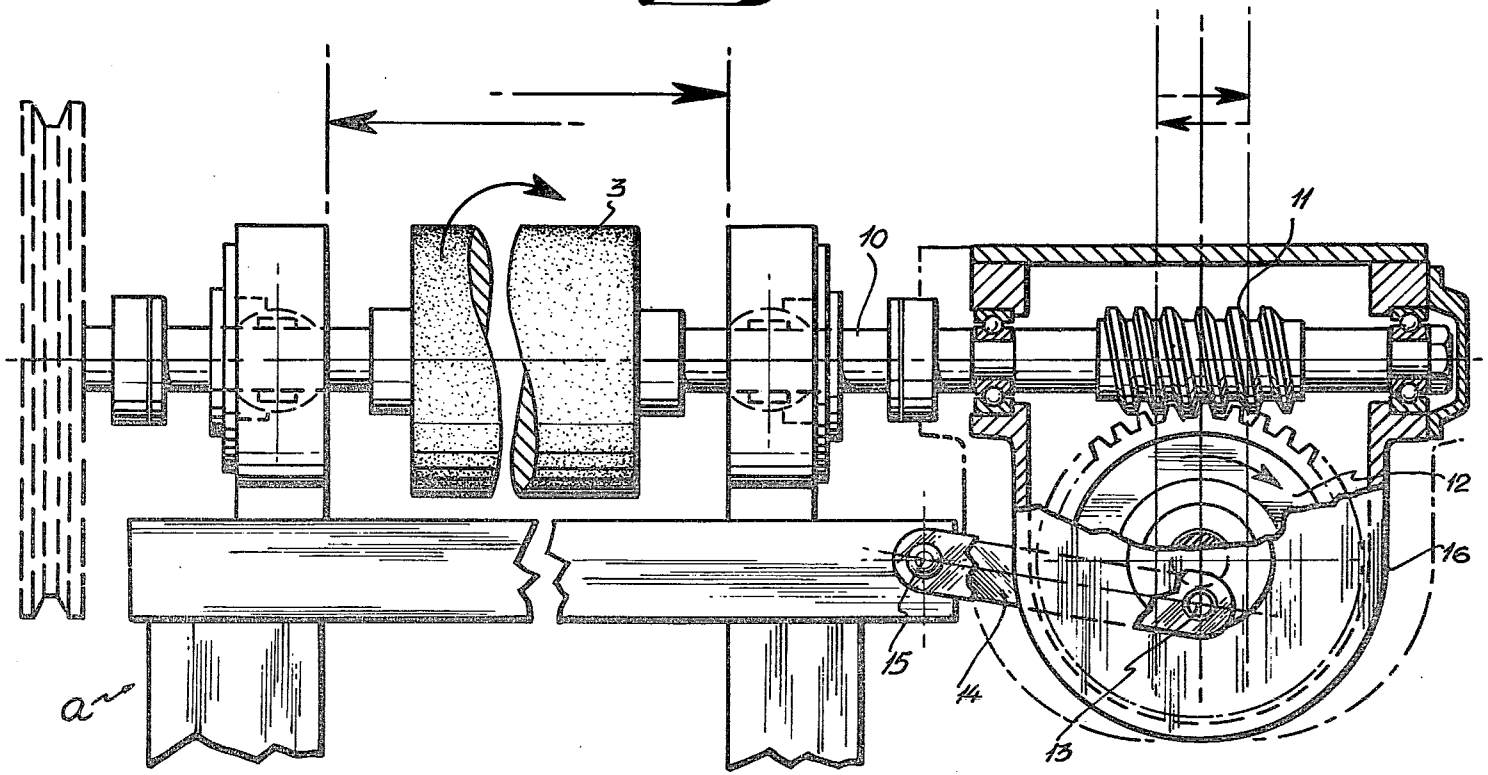
FIG. 2 is a partial view in detail, which shows, in section the specific mechanism of each one of the abrasion means which determines, in response to its rotary movement, the transverse oscillation of the mechanism.
Figure 5:
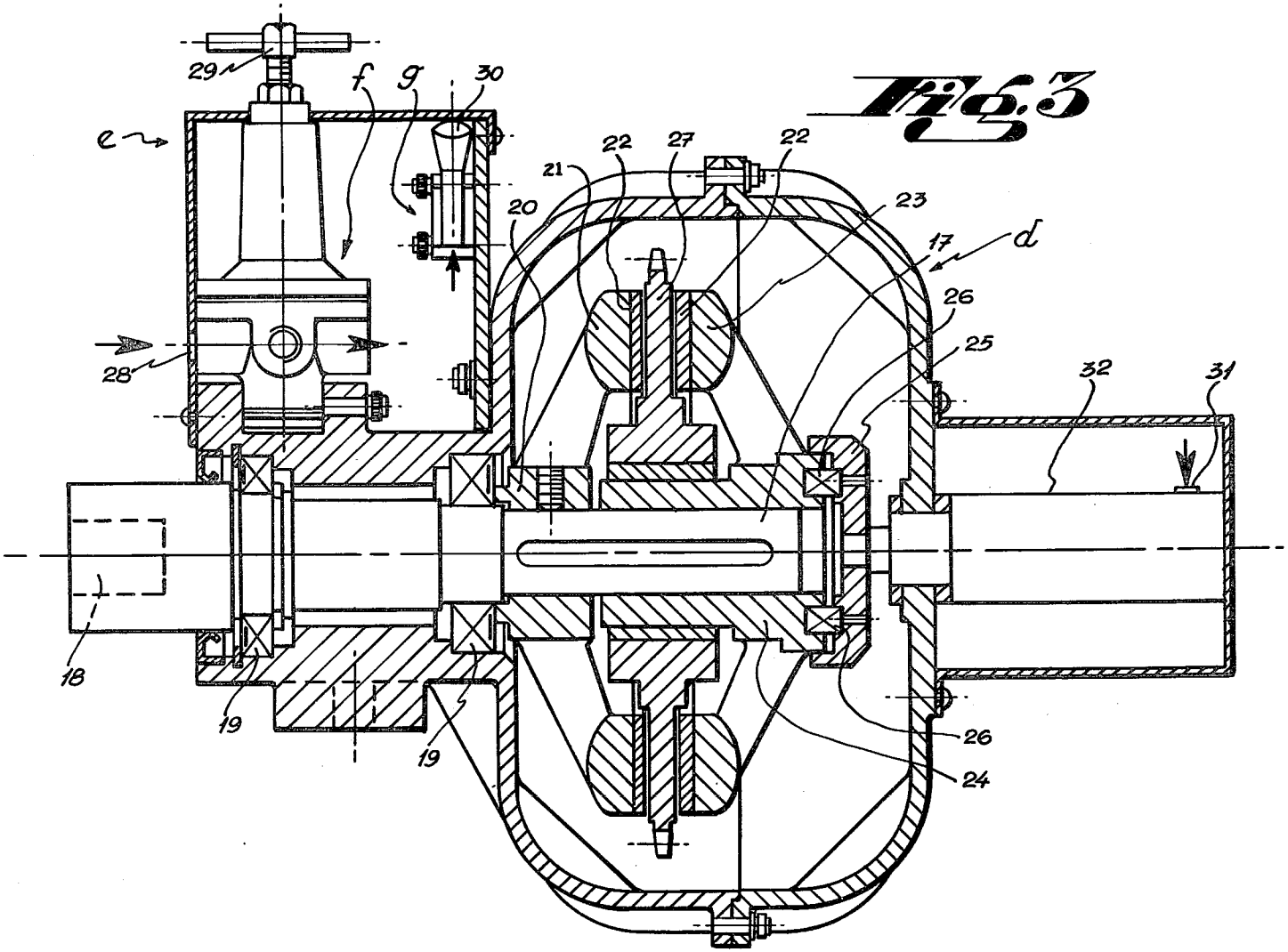
FIG. 5 is a view similar to FIG. 4 showing only the section of the warp thread.
Figure 4:
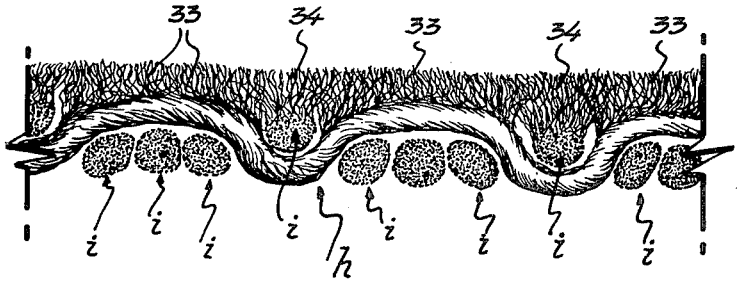
FIG. 4 is an enlarged view of a partial section of the fabric obtained in the present process according to a parallel plane adjacent to a warp thread of the fabric.
Figure 5:
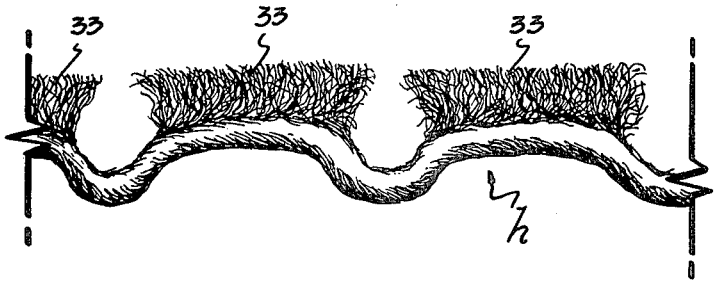

The grinding cylinders 3 are adapted to provide simultaneously with their rotary movement in the direction of fabric motion, a transverse oscillation. This is shown in FIG. 2 wherein axles 10 have protruding ends which carry a rim of endless threads 11 in which respective sprockets 12 coact. Each sprocket 12 is eccentrically jointed or articulated at 13 with the end of a connecting-rod arm 14 whose opposite end is, in turn, articulated at 15 at a fixed point of frame a.

The assembly of threaded rim 11 and sprocket 12 is located inside a box 16 which is mounted over the axle 10. Axle 10 has a free rotation with respect to box 16, but is fixed in relation to axial displacement.

As can be appreciated in FIG. 2, the sprocket 12 is permanently geared with the threaded rim 11 which causes it to rotate and, as the terminal 15 of the connecting rod 14 is articulated at a fixed point, the displacement of the opposite end 13 of rod 14, excentrically articulated on sprocket 12, forces the displacement, with respect to said fixed point 15, of the assembly comprising axle 10, endless thread rim 11, wheel 12 and box 16 in the orbit indicated by the arrows in FIG. 2. This impresses on the grinding cylinder 3, in response to its rotary movement, a transverse oscillation in relation to the fabric as its advances simultaneous with the rotation of the cylinder.

The winders c and c′ are located at both ends of the machine as indicated schematically in FIG. 1. Each of the winders has a respective regulating device as shown in FIG. 3, enclosed in a "case" positioned at the end 17 of an axle whose opposite, extended end comprises a means for mounting the winding rod, and which is in conjunction with the regulating device.

This axle is mounted on bearings 19 and carries, at 20, the nucleus of a ring-shaped piece 21 with a friction surface or coupling patch, facing a symmetrical, ring-like piece 23, also with a friction surface 22, which is mounted with its nucleus 24, in the form of a collar or sleeve, axially displaceable over the mentioned axle through a drive ring 25 mounted on bearings 26.

The facing piece 21 is in a fixed position on the axle and the facing piece 23 is axially displaceable thereover. Between the friction surfaces 22 of the facing pieces 21 and 23 is displaceably located a plate or sprocket 27 which receives, by means of a transmission passing through an opening of the body d (not illustrated) motive power. The toothed plate transmission can be connected by means of a chain, gears or any other adequate form of transmission, to the source of the motive power.

In a box e fixed to the body d, which has an inlet 28 for connection to a source of air under pressure (not illustrated), there is located a pressure-regulating valve f, which is complemented with a manometer. Valve f is controllable or adjustable from outside of the box e by a manual activating handle 29. The pressurized air is regulated by valve f and passes through a three-way valve g, controlled or adjusted by an adjusting member 30, which is in communication with the inlet 31 of a pneumatic microcylinder 32. The piston of cylinder 32 is connected to the drive ring 25, as can be seen in the mentioned FIG. 3.

The operating characteristics of these valves are not shown in detail, along with the details of the microcylinder, because they are conventional and well known to the art.

In FIG. 3 arrows show the entrance of the pressurized air into the regulating device, to the control valve g and from this, by means of appropriate valves and/or conduits (not shown) to the pneumatic microcylinder 32.

The valve f regulates the air pressure in the device, while the three-way control valve g communicates with the microcylinder 32, blocks the regulating valve f and discharges microcylinder 32.

The toothed plate 27 is moved or rotated by an outside transmission and, when the device is in the position illustrated in FIG. 3, it rotates freely with respect to the axle over whose end 17 the plate is mounted.

When the pressurized air passes to the microcylinder 32, the cylinder piston drives the ring 25 forward and, with it, the nucleus piece 24 and its ring-shaped portion 23, and friction surface 22 (comprising "Ferodo" or other similar brake lining material) is pressed against the side of toothed plate 27 and causes the opposite side of plate 27 to be pressed against the friction surface 22 of ring-shaped piece 21. Thus, plate 27 is being contacted in coupling between friction surfaces 22. The greater the pressure on the microcylinder 32 through the pneumatic system of the regulating device, the greater will be the pressure and the smaller the slippage between the plate 27 and the friction surfaces 22 of the ring-shaped pieces 21 and 23. The exact pressure is regulated by means of valve f. The fabric winding rod is connected in the terminal 18 of the device.

To uncouple toothed plate 27, it is sufficient, by means of operating valve g, to block regulating valve f, and discharge the pneumatic microcylinder 32, whereby plate 27 is allowed to rotate independently over the end 17 of the axle. Given the pneumatic characteristics of the activation means, the coupling as well as the uncoupling are effected elastically.

In the operation for winding the fabric, the speed of the axle is regulated by means of the air pressure which, as has been said, determines the amount of slippage due to the friction between patches 22 and the toothed plate 27. In the same manner, in feeding the fabric to the machine, the mechanism for transmission of movement to the plate 27 is blocked and the air pressure regulates the braking effect by friction of the control device and, with it, the lengthwise tension of the fabric is regulated.

If great frictional forces are required in the device, the coupling means illustrated as an example in FIG. 3, can be replaced by a mechanism of multiple discs.

The process for conditioning the fabric is based, on submitting a fabric with threads, whether they be of warp, of woof, or both together, dyed in a substantially superficial manner, to a superficial abrasion based on a combustion of relative movement between the fabric and the abrasion means thereby producing a superficial "loosening" of the fibers. This causes a predetermined discoloration and/or change of tone with a simultaneous "plushing" of the fabric, without affecting the deep structure of the yarn.

As has been expressed before, this process must be practiced under predetermined conditions, in accordance with the type and characteristics of the fabric to be treated.

The object of the abrasion applied to the fabric is the "loosening" of the superficially dyed fibers of the threads and to only raise the fibrils of these threads to provoke a variation of the coloration and/or tone of the fabric, as well as "plushing" the surface of the fabric and eliminating therefrom a minimum of fiber or fiber particles. This condition of minimum napping is verified by observing the aspiration device, whose charge is minimal and which does not require very frequent emptying because of the relatively small amount of fuzz collected in it.

The process is practiced under very controlled regulated conditions, wherein during the passage of the fabric through the process, the least lengthwise tension possible is imposed on the moving fabric thereby causing the fabric to be re-wound very evenly and avoiding variations in the width of the fabric. In the initial winding a threading device is used to aid in avoiding variations in the fabric width.

In addition, there must be maintained a substantially small contact surface between the abrasion means and the fabric under treatment. That is, the arc of movement of each grinding cylinder 3, over the fabric, should not be very broad, which means the arc should be adapted to the diameter of grinding cylinder 3 and the pressure of the cylinder on the fabric to obtain the desired condition of small contact surface. The difference in speeds between the advancing fabric and the peripheral velocity of the grinding cylinders 3 is also regulated to make it possible to insure the development of the previously mentioned characteristics in the resulting product.

It is evident that a repetition of the specific treatment mentioned, as well as the dimensions of the grains of the surfaces on the abrasion means, are established in proportion to the characteristics of the fabric to be treated, that is, the thickness, weight, and type of threads making up the fabric.

As the fabric advances through the treatment, the grinding cylinders 3 supported over the fabric rotate at a peripheral velocity out of phase with that of the advancing fabric and are simultaneously displaced in an oscillating movement transverse to the direction of advance to obtain a superficial loosening of fibers over the entire surface in a combined movement, thus eliminating the possibility of forming lengthwise scratches or streaks in the fabric. Given the characteristics of the dye used in the fabric, such superficial abrasion causes discoloration and/or change of tone in the fabric in an even and predetermined form and, simultaneously, a "plushing" of its surface.

The treated fabric is particularly characterized as having warp threads and woof threads of a substantially low number count i.e., the number of hanks of 840 yards contained in a single English pound of yarn. Preferred yarns have a number of about 6–16 for a one thread yarn and its equivalent for yarns of two or more twisted threads. In addition, at least the warp threads have a substantially high torsion.

The process is particularly improved by carrying it out under conditions of controlled dampening. This is accomplished by controlled amounts of steam passing through pipes 7 and 8. This reduces or eliminates the possibility that the fibers of the fabric will become charged with static electricity. Further, the swelling of the fibers obtained upon exposure to steam favors the abrasion treatment and makes possible a reduction in the number of passes to which the fabric is submitted.

A type of fabric is illustrated in detail, as an example, in FIGS. 4 to 7. This fabric is a cotton cloth, twill 3xl, whose threads of the warp identified with the letter h, are dyed in substantially superficial form, whereas the woof threads i are not dyed. The abrasion treatment causes a raising of fibrils 33 and 34 which, upon becoming mixed together, produce a change in the tonality of the fabric.

Figure 6:
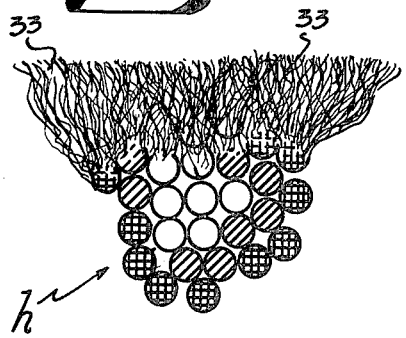
FIG. 6 is an enlarged schematic view which shows a section of yarn dyed in superficial form and treated according to the process of the invention.

As shown in FIG. 6, a transverse section of a warp thread, superficially dyed and indicated with h, the outer threads of the thread have color (cross hatched) while those threads in the nucleus are undyed. It is also possible to find intermediate threads that are partially colored (lined), as indicated in FIG. 6. The effect of the superficial abrasion causes a raising of fibrils 33 which, on becoming mixed, and without affecting the deep structure of the yarn, produce the change of tonality as previously noted. The surface of the treated fabric then has a bi-tonal effect.

It is unquestionable that on being carried into practice, the present invention can have introduced into it modifications with regard to certain details without any deviation from the fundamental principles which are clearly specified in the following claims.

I claim as my invention:

1. A textile fabric comprising a plurality of interwoven warp and woof threads having a substantially low number count, at least one of said warp and woof threads having a substantially high torsion, at least one of said warp and woof threads being dyed a predetermined base color, and fibrils superficially raised on the surface of at least one side of said fabric and intermingled with each other to provide a plushed surface and a change in tonality of said surface from said predetermined base color.

2. The fabric of claim 1 wherein said dyed threads are superficially dyed only.

3. The fabric of claim 1 wherein only one of said warp and woof threads are dyed and the other of said warp and woof threads are undyed, said dyed and undyed threads on said one side of said fabric having said fibrils superficially raised therefrom.

4. The fabric of claim 3 wherein said dyed threads are superficially dyed only.

5. The fabric of claim 1 wherein said warp threads have a substantially high torsion.

6. A textile fabric according to claim 1 wherein said threads have a number count in the range of about 6–16.

7. The fabric of claim 1 wherein the surface of said fabric having said superficially raised fibrils also has a design imprinted thereon.

8. The fabric of claim 1 wherein only said warp threads are dyed.

* * * * *